US006542061B2

(12) United States Patent
Santa Cruz et al.

(10) Patent No.: US 6,542,061 B2
(45) Date of Patent: Apr. 1, 2003

(54) INDICATOR LIGHT FOR USE IN COMBINATION WITH AN ELECTRICAL CIRCUIT PROTECTOR OR FUSE

(76) Inventors: Cathy D. Santa Cruz, 7630 Tholl Dr., Reno, NV (US) 89506; Galen J. May, 2251 Cielo Vista Dr., Sparks, NV (US) 89436

( * ) Notice: Subject to any disclaimer, the term of this patent is extended or adjusted under 35 U.S.C. 154(b) by 0 days.

(21) Appl. No.: 10/114,856

(22) Filed: Apr. 2, 2002

(65) Prior Publication Data

US 2002/0149464 A1 Oct. 17, 2002

Related U.S. Application Data

(60) Provisional application No. 60/284,166, filed on Apr. 16, 2001.

(51) Int. Cl.[7] ..... H01H 71/04; H01H 37/08; H01H 9/16

(52) U.S. Cl. ..... 337/79; 337/37; 337/66; 337/376; 200/314; 200/310; 200/312

(58) Field of Search ..... 337/36, 37, 59, 337/112, 66, 79, 333, 334, 376; 200/308–317

(56) References Cited

U.S. PATENT DOCUMENTS

| | | | | | |
|---|---|---|---|---|---|
| 1,732,295 | A | * | 10/1929 | Aichele | 337/68 |
| 2,242,232 | A | * | 5/1941 | Cappelle | 337/62 |
| 2,439,338 | A | * | 4/1948 | Fuge et al. | 337/91 |
| 2,487,725 | A | * | 11/1949 | Platz | 337/73 |
| 2,496,049 | A | * | 1/1950 | Henry, Jr. | 337/113 |
| 2,496,759 | A | * | 2/1950 | Warsher | 337/76 |
| 2,647,969 | A | * | 8/1953 | Marcoz | 337/82 |
| 2,824,932 | A | * | 2/1958 | Ellenberger | 337/66 |
| 3,108,165 | A | * | 10/1963 | Cinibulk | 337/66 |
| 3,356,816 | A | * | 12/1967 | Clarke | 337/75 |
| 3,729,607 | A | * | 4/1973 | Ellenberger | 200/314 |
| 4,056,816 | A | * | 11/1977 | Guim | 340/638 |
| 4,342,979 | A | * | 8/1982 | Phillips | 337/41 |
| 4,345,233 | A | * | 8/1982 | Matthies | 337/75 |
| 4,612,528 | A | * | 9/1986 | Peter | 337/79 |
| 4,630,020 | A | * | 12/1986 | Yang | 337/79 |
| 4,635,021 | A | * | 1/1987 | Hsieh | 337/76 |
| 4,768,025 | A | * | 8/1988 | Vila-Masot | 340/638 |
| 4,939,495 | A | * | 7/1990 | Peterson et al. | 337/79 |
| 5,089,799 | A | * | 2/1992 | Sorenson | 337/68 |
| 5,264,818 | A | * | 11/1993 | Truchet et al. | 337/79 |
| 5,459,446 | A | * | 10/1995 | Vidal et al. | 337/188 |
| 5,534,840 | A | * | 7/1996 | Cuingnet | 337/1 |
| 6,377,158 | B1 | * | 4/2002 | Yu | 337/37 |
| 6,445,273 | B1 | * | 9/2002 | Yu | 337/37 |
| 6,445,275 | B2 | * | 9/2002 | Yu | 337/68 |
| 6,448,880 | B2 | * | 9/2002 | Yu | 337/66 |
| 6,456,185 | B1 | * | 9/2002 | Yu | 337/37 |

FOREIGN PATENT DOCUMENTS

| | | | | | |
|---|---|---|---|---|---|
| JP | 02046618 | A | * | 2/1990 | H01H/71/04 |

* cited by examiner

*Primary Examiner*—Anatoly Vortman

(57) ABSTRACT

An indicator light which when installed in combination with either a circuit protector or a fuse, etc., will automatically illuminate to notify a user that an electrical overload has occurred.

7 Claims, 2 Drawing Sheets

INDICATOR LIGHT FOR USE IN COMBINATION WITH AN ELECTRICAL CIRCUIT PROTECTOR OR FUSE

RELATED APPLICATION

This application is derived from our provisional application No. 60/284,166, which was filed on Apr. 4, 2001.

FIELD OF THE INVENTION

The present invention pertains to improvements connected with a prior art circuit protector or fuse but more particularly relates to an improvement incorporating use of an indicator light which automatically illuminates when actuated by the circuit protector or a blown fuse when a circuit overload has occurred.

BACKGROUND OF THE INVENTION

Many types of circuit protectors exist and various types of indicator lights have been taught in the past. However until now, a combination of a circuit protector with an indicator light has not been addressed, recognized or even proposed within the known prior art.

At the present time, a very common circuit protector which is readily available on the market, is substantially a combination of two different patents. Namely, U.S. Pat. No. 4,922,219 entitled "CIRCUIT BREAKER", and U.S. Pat. No. 4,587,164 entitled "SNAP-IN BUSHING, both of which are issued to joint inventors Kenneth C. Bakhaus and Bruce C. Sdunek. Wherein the actual mechanics of the circuit breaker of the Pat. No. 4,922,219 has been modified to include the snap-in bushing of the Pat. No. 4,687,164 reference, respectively. Whereby, the resultant combination of the two noted patents is an electrical circuit protector that is of a shape and size to be easily accepted in a conventional circular aperture in a typical mounting panel. This combination is sold and produced by MECHANICAL PRODUCTS INC., of Jackson Michigan part #0900.

It is to be understood and respected that the resultant circuit protector is novel and well accepted and highly utilized within the field. However, it would be most advantageous and a much needed improvement if such a circuit protector were to include an indicator light which automatically illuminates when the protector senses and disengages the circuit when an electrical overload has incurred. Unfortunately, the noted circuit protector only provides a pop-up switch and this is not efficient for quickly visually indicating to maintenance personnel that an electrical overload has occurred.

SUMMARY OF THE INVENTION

It is therefore an important object of the present invention to provide an indicator light for use with an electrical circuit protector, which is automatically actuated by the circuit protector when an electrical circuit overload has occurred.

It is another object of the present invention to provide an indicator light for use with an electrical circuit protector that can be either installed within the electrical circuit protector after market by the consumer, or it can easily be incorporated at the point of manufacture.

It is a very important object of the present invention to provide an indicator light for use with an electrical circuit protector that provides most unusual results and quickly visually notifies the user that an electrical overload has occurred. It is to be understood that such electrical protectors are normally installed in multiples and it is very difficult to determine which of the electrical circuit protectors have been actuated. This is especially evident when the mounting panel is positioned in a darkened area, or during the nighttime. In such a situation it can be extremely difficult and irritating when one is searching for the proper electrical circuit protector. Thus the present invention eliminates guess-work for the user as well as saves time and wasted energy.

Still a further object of the present invention is to provide an indicator light for use with an electrical circuit protector which can be any suitable light means of engineering choice. For example, such suitable light means includes but is not limited to a pre-existing light source, such as a light emitting diode "LED" or the like.

Yet another object of the present invention is to provide an indicator light for use with an electrical circuit protector which is economical to manufacture and easily marketable. Also, the present invention is most suitable for use with circuit protectors and/or fuse housings which are made from conductive plastics.

Other objects and advantages will be seen when taken into consideration with the following specification and drawings.

DETAILED DESCRIPTION OF THE DRAWINGS

Figure 1:
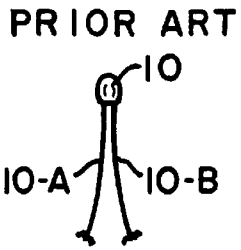
FIG. 1 is substantially an overview of the preferred type of prior art indicator light source which is suitable for use for the present invention.
Figure 2:
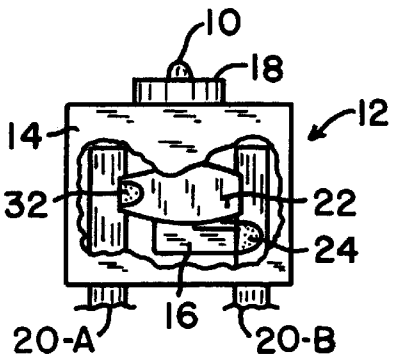
FIG. 2 is substantially a partial internal overview of the present invention when installed on a prior art electrical circuit protector and illustrates a first embodiment.

Referring now in detail to the drawings wherein like characters refer to like elements throughout the various views. In reference to FIG. 1, (10) substantially represents a circuit overload indicator light which is to be used in combination with an electrical circuit protector (12) as shown in FIG. 2. It is to be understood that the noted indicator light of the preferred embodiment substantially comprises a circuit overload indicator light (10) having a first and second lead line (10-A & 10-B) extending there from for energizing indicator light (10). An example of one suitable type of circuit overload indicator light is sold by RADIO SHACKS® entitled "micro lamp" part #7219. However, it is to be further understood that any other suitable type of circuit overload indicator light of engineering choice may be used.

In reference to FIG. 2, we depict a first embodiment of a typical prior art electrical circuit protector (12), such as taught within U.S. Pat. No. 4,687,164, which substantially includes a circuit protector housing (14) for containment of all the electrical components. With all the electrical components being interconnected for electrical communication there between, and such components are typically associated with the noted electrical circuit protector (12). Thus having but not limited to, a first terminal (20-A), a second terminal (20-B), a current responsive bimetallic element (22) and an interrupter blade reset button (16) which is slidably engaged within a button housing (18). With interrupter blade reset button (16) being interconnected to a suitable actuating means such as a spring (not shown for clarity purposes) or the like, for actuating interrupter blade reset button (16) between an activated position and an inactivated position.

It can now be understood in typical operation, when interrupter blade reset button (16) is in its inactivated position, the electrical circuit protector (12) when installed in-line within a typical electrical circuit, allows an electrical current to flow without interruption. However, when an electrical current overload occurs, bimetallic element (22) which is responsive to heat caused by an electrical overload, automatically deforms into a bent shape, which in turn causes the actuating means to force interrupter blade reset button (16) upward in a protruding manner from within button housing (18). Thus, interrupter blade reset button (16) automatically assumes its activated position when an overload has occurred. This process is well known and documented within the noted prior art.

It can now be seen the noted electrical circuit protector (12) automatically notifies maintenance personnel that a circuit overload has occurred, as they can visually see that interrupter blade reset button (16) is protruding from within button housing (18) and therefore the cause must be determined and repaired accordingly.

However, this type of notification means is not nearly as effective as is the use of a circuit overload indicator light (10). Therefore, the present invention incorporates the above process but further includes the noted a circuit overload indicator light (10) which when installed in the following manner automatically illuminates when interrupter blade reset button (16) assumes its actuated position.

It is to be understood the circuit overload indicator light (10) can be installed in multiple ways and some of the possible installation methods will be addressed hereafter. However, the invention is not to be limited to such installation methods but is to include other types of methods which may become applicable over time.

Figure 3:
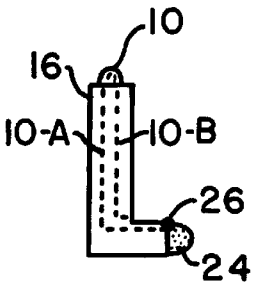
FIG. 3 substantially illustrates a front view of an interrupter blade reset button having an electrically connected circuit overload indictor light installed thereon.
Figure 4:
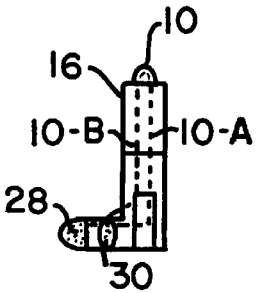
FIG. 4 substantially illustrates a backside view of FIG. 3.

Referring now to FIGS. 3 & 4, wherein we depict the preferred embodiment for installing the circuit overload indicator light (10). It is to be understood that overload indicator light (10) is to be substantially mounted at a location of choice onto or within interrupter blade reset button (16) by any suitable attachment means of choice, such as glue, etc. While the leads (10A & 10B) extending there from are installed onto or within interrupter blade reset button (16) as follows.

In FIG. 3, we show substantially a front side of interrupter blade reset button (16) which includes an electroplated section (24), and first lead line (10-A) of circuit overload indicator light (10) is fixedly attached at a suitable location of engineering choice onto or within interrupter blade reset button (16), and interconnected onto electroplated section (24) by appropriate attachment means of choice, such as solder (26), or the like.

In FIG. 4, we show substantially a back side of interrupter blade reset button (16) which includes an electroplated section (28), and second lead line (10-B) of circuit overload indicator light (10) is fixedly attached at a suitable location of engineering choice onto or within interrupter blade reset button (16) and interconnected onto electroplated section (28) by appropriate attachment means of choice, such as by solder (30), or the like.

Thus it can clearly be seen when interrupter blade reset button (16) assumes its activated position, first and second lead lines (10-A & 10-B) are simultaneously energized, and in turn circuit overload indicator light (10) automatically illuminates.

It is to be understood this is the most economical and efficient manner for incorporating the circuit overload indicator light (10) into an electrical circuit protector (12), as this can be easily accomplished at the point of manufacture as very little engineering or production line costs would be involved, which is very important.

Figure 5:
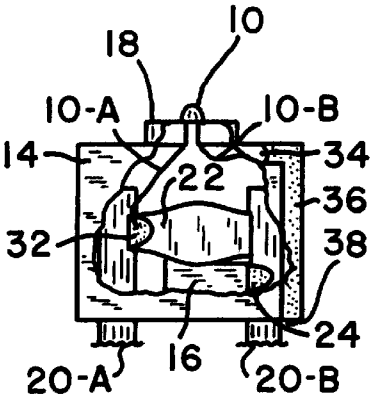
FIG. 5 is substantially a partial internal overview of the present invention when installed on a prior art electrical circuit protector and illustrates a second embodiment.

Another type of assembly means is depicted in FIG. 5, which again would involve very little modification. Wherein the circuit overload indicator light (10) is mounted into a recess formed within button housing (18) with first and second lead lines being retained within a recess formed within button housing (18). With first lead line (10-A) of circuit overload indicator light (10) being interconnected to first terminal (20-A) at a location of engineering choice by appropriate attachment means such as solder (32). With second lead line (10-B) of circuit overload indicator light (10) being interconnected at a location of engineering choice by appropriate attachment means such as solder (34), onto an electroplated section (36), which is in communication with and attached to second terminal (20-B) at a location of engineering choice by appropriate communication and attachment means such as solder (38).

Figure 6:
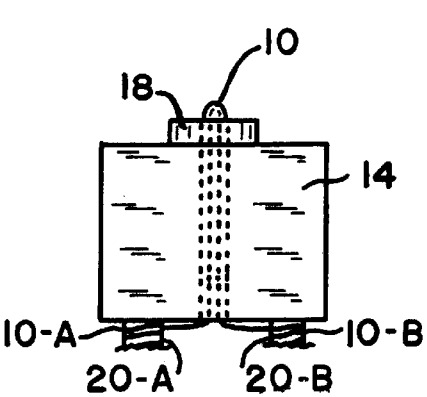
FIG. 6 is substantially an external overview of the present invention when installed on a prior art electrical circuit protector and illustrates a third embodiment.

Referring now to FIG. 6, wherein yet another type of assembly means is depicted, and again would involve very little modification. Wherein the circuit overload indicator light (10) is mounted onto button housing (18), and circuit protector housing (14) includes a hole there through which is of a shape and size to slidably receive first and second lead line (10-A & 10-B) there through. With first lead line (10-A) being of a sufficient length to extend from within the hole and throughout circuit protector housing (14), and first lead line (10-A) being fixedly attached to first terminal (20-A) by functional attachment means of engineering choice, such as by wrapping first lead line (10-A) around first terminal (20-A).

Also, second lead line (10-B) is of a sufficient length to extend from within the hole and throughout circuit protector housing (14), and second lead line (10-B) being fixedly attached to second terminal (20-B) by functional attachment means of engineering choice, such as by wrapping second lead line (10-B) around second terminal (20-B).

Figure 7:
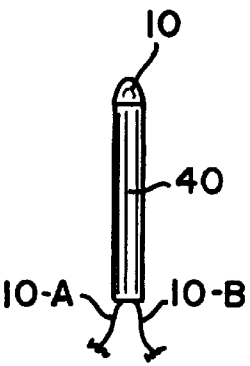
FIG. 7 is substantially an overview of the present invention when assembled in the form of a light stick.

In reference to FIG. 7, the embodiment as described above may further include circuit overload indicator light (10) and first and second lead lines (10-A & 10-B) being contained within an elongated housing which in combination form a light stick (40) and circuit protector housing (14) and button housing (18) having a hole there through for slidably receiving light stick (40) there through.

The present invention is to include other types of embodiments so as to be usable with various types of fuses and/or circuit breakers, as will be seen. However it is to be understood the overall end result is substantially the same as in each case the circuit overload indicator light (10) when installed will automatically illuminate upon an electrical overload.

Figure 8:
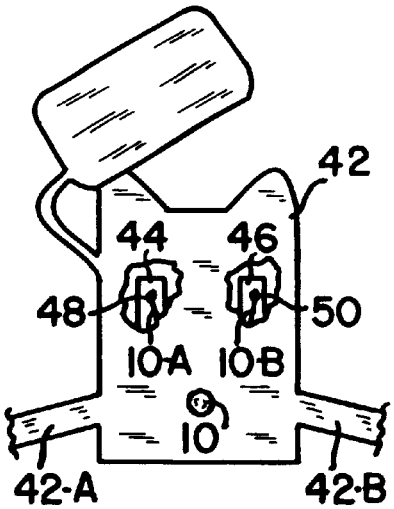
FIG. 8 is substantially an overview of a prior art fuse holder having the circuit overload indicator light of the present invention installed therein.

Referring now to FIG. 8 wherein illustrated is a prior art fuse holder (42) which is used for removably receiving, energizing and supporting a fuse (not shown) therein. The fuse holder (42) having a first electrical lead line (42-A) extending there from, a second electrical lead line (42-B) extending there from, a first terminal (44) and a second terminal (46). With first electrical lead line (42-A) being in communication and interconnected onto first terminal (44) and second electrical lead line (42-B) being in communication and interconnected onto second terminal (46).

It will now be seen the present invention is intended to include the noted prior art fuse holder (42) in combination with the a circuit overload indicator light (10), which when combined and installed as described hereafter, allows maintenance personnel to easily determine that the fuse (not shown) which is installed within fuse holder (42) has blown and must be replaced, as circuit overload indicator light (10) will automatically illuminate when an electrical overload has occurred.

Figure 9:
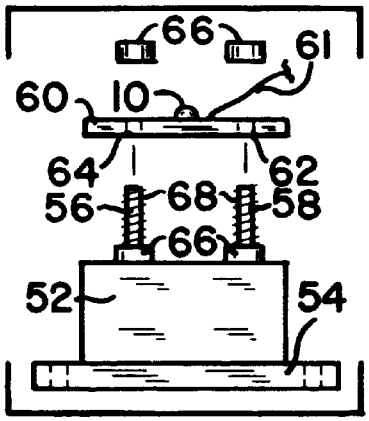
FIG. 9 is substantially a plan view for installing a commutator strip of the present invention onto a different type of prior art circuit protector housing.

It is to be understood circuit overload indicator light (10) can be fixedly mounted onto fuse holder (42) at any suitable location of engineering choice, and first lead line (10-A) is fixedly attached to first terminal (44) by any appropriate attachment means, such as solder (48) or the like. With second terminal lead (10-B) being attached to second terminal (46) by any appropriate attachment means, such as solder (50) or the like. Whereby, it will now be seen circuit overload indicator light (10) will automatically illuminate when an electrical overload has occurred, thus notifying maintenance personnel that the fuse (not shown) has blown and must be replaced. Referring now to FIG. 9, wherein we depict yet another type of prior art circuit protector which is in the form of a housing (52) and an alternative method for indicating when an electrical overload has occurred. Wherein circuit protector housing (52) includes a mounting plate (54) for mounting circuit protector housing (52), a first terminal (56) and a second terminal (58). The present invention includes the teachings of the noted prior art and housing thereof. However, it is now improved as our current invention includes herein and teaches a commutator strip (60) which is of a shape and size to substantially mate with a top portion of circuit protector housing (52). The commutator strip (60) being made from substantially any suitable material of engineering choice which allows for negative and positive contacts (not shown) to be laminated therein. Circuit overload indicator light (10), and first and second leads are also laminated within commutator strip (60). It is to be understood that commutator strip (60) further includes a first opening (62) which is of a shape and size to slidably receive first terminal (56) there through, and a second opening (64) which is of a shape and size to slidably receive second terminal (58) there through. Also, commutator strip (60) may farther include means for delivering a light beam to a remote location, such as to a circuit breaker box, or the like when the circuit overload indicator light is illuminated. Whereby commutator strip (60) may include a fiber optic line (61) which is interconnected to a remote location of choice.

Thus, it can now clearly be seen that commutator strip (60) can be easily slidably engaged over each of the terminals (56 & 58) onto the top section of circuit protector housing (52) and then securely fastened by suitable fastening means, such as nuts (66) and bolts (68). Whereby, when an electrical overload has occurred, the commutator strip (60) will automatically energize and illuminate the circuit overload indicator light (10).

Figure 10:
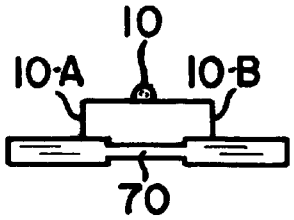
FIG. 10 is substantially an overview depicting one possible means for electrically connecting a circuit overload indicator light to a prior art fusible link.

Referring now to FIG. 10, wherein depicted is a prior art fusible link (70) which is normally used in many different types of fuses and when an electrical overload has occurred the fusible link will automatically break. Therefore, it would be most advantageous to include the circuit overload indicator light (10) being installed in line and electrically connected within the existing circuitry normally associated with the fusible link (70). It is to be understood this circuitry in combination can be incorporated in a number of different ways, thus the preferred embodiment is not taught herein, just the concept of the combination of a fusible link (70) and the circuit overload indicator light (10).

Figure 11:
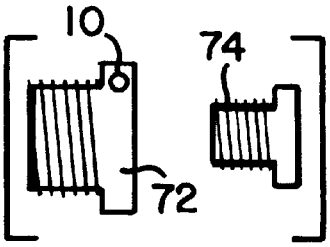
FIG. 11 is substantially a plan view for a glass fuse adapter having the circuit overload indicator light installed therein.

Referring now to FIG. 11, wherein illustrated is a fuse adapter (72) which is of a shape and size to be threadably engaged within a typical pre-existing fuse receptacle (not shown), and fuse adapter (72) having a housing for containment of circuit overload indicator light with the circuitry for energizing circuit overload indicator light (10) and appropriate circuitry normally associated with a fuse adapter (72) therein. It is to be understood that it may be useful to include adjustment means for controlling return amperage, voltage or current after the fuse has blown so as to protect against accidental shock and/or circuit overload. Such adjustment means may include a resister or any other suitable means of engineering choice. Also, fuse adapter (72) is internally threaded for threadably receiving a prior art fuse (74) therein. In use, when fuse adapter (72) is installed within the noted fuse receptacle, circuit overload indicator light (10) automatically illuminates. However, when the prior art fuse (74) is threadably inserted and fixedly attached within fuse adapter (72), circuit overload indicator light (10) automatically goes off. Thereafter, when prior art fuse (74) is subjected to an electrical overload, the prior art fuse (74) blows in the normal manner, and again the circuit overload indicator light (10) automatically illuminates and notifies maintenance personnel that the prior art fuse (74) must be replaced.

Figure 12:
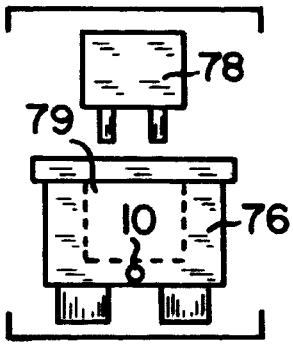
FIG. 12 is substantially a plan view for an in-line fuse adapter having the circuit overload indicator light installed therein.

Referring now to FIG. 12, wherein illustrated is yet another embodiment including an in-line fuse adapter (76) having a housing which is of a shape and size to be frictionally engaged within a typical in-line fuse receptacle (not shown), and in-line fuse adapter (76) includes the circuit overload indicator light (10) and appropriate circuitry for energizing circuit overload indicator light (10) and appropriate circuitry normally associated with in-line fuse adaptor (76) therein. Also, in-line fuse adapter (76) includes an internal cavity for receiving and retaining a typical pre-existing in-line fuse (78) therein. In use, when in-line fuse adapter housing (76) is installed within the noted fuse receptacle, circuit overload indicator light (10) automatically illuminates. However, when the prior art in-line fuse (78) is inserted and fixedly attached within in-line fuse adapter (76), circuit overload indicator light (10) automatically goes off. Thereafter, when prior art in-line fuse (78) is subjected to an electrical overload, the prior art in-line fuse (78) blows in the normal manner, and again the circuit overload indicator light (10) automatically illuminates and notifies maintenance personnel that the prior art in-line fuse (78) must be replaced. Again, it may be useful to include adjustment means for controlling return amperage, voltage or current after the fuse has blown so as to protect against accidental shock and/or circuit overload. Such adjustment means may include a resister or any other suitable means of engineering choice.

It will now be seen, we have herein provided a new combination of typical prior art circuit protectors and/or circuit breakers which include a circuit overload indicator light (10) therewith, which in combination provide unique and novel end results which heretofore have not been recognized nor addressed as taught within the present invention.

Thus, it is to be understood many different types of circuit breakers and/or protectors are to be inherent herein, as the overall combination of such devices having an overload indicator light therewith is the general overview of the present invention.

Although the invention has been herein shown and described in what is conceived to be the most practical and preferred embodiments, it is recognized that departures may be made there from within the scope and spirit of the invention, which is not to be limited to the details disclosed herein but is to be accorded the full scope of the claims so as to embrace any and all equivalent devices and apparatus.

What we claim as new and wish to secure by letters patent is:

1. A circuit overload indicator light for use in combination with an electrical circuit protector comprising: a circuit overload indicator light; and an electrical circuit protector; said circuit overload indicator light having a first lead line and a second lead line extending there from for energizing said circuit overload indicator light, said electrical circuit protector having a housing for containment of all electrical components associated with said electrical circuit protector, said electrical circuit protector having a button housing, said all electrical components being interconnected for electrical communication there between, said electrical components including; a first terminal; a second terminal; a current responsive bimetallic element; and an interrupter blade reset button; said interrupter blade reset button having an activated position and an inactivated position, said circuit overload indicator light being mounted onto or within said interrupter blade reset button by suitable attachment means, said interrupter blade reset button having a front side which includes an electroplated section, said interrupter blade reset button having a back side which includes an electroplated section, said first lead line being fixedly attached onto or within said interrupter blade reset button by appropriate attachment means and interconnected to said electroplated section of said front side, and said second lead line being fixedly attached onto or within said interrupter blade reset button by appropriate attachment means and interconnected to said electroplated section of said back side, whereby when said electrical circuit protector is subjected to an electrical overload, said interrupter blade reset button assumes said activated position which in turn automatically illuminates said circuit overload indicator light.

2. The circuit overload indicator light for use in combination with an electrical circuit protector of claim 1 wherein each said appropriate attachment means is solder.

3. The circuit overload indicator light for use in combination with an electrical circuit protector of claim 1 wherein said suitable attachment means is glue.

4. A circuit overload indicator light for use in combination with an electrical circuit protector comprising: a circuit overload indicator light; and an electrical circuit protector; said circuit overload indicator light having a first lead line and a second lead line extending there from for energizing said circuit overload indicator light, said electrical circuit protector having a housing for containment of all electrical components associated with said electrical circuit protector, said electrical circuit protector having a button housing, said all electrical components being interconnected for electrical communication there between, said electrical components including; a first terminal; a second terminal; a current responsive bimetallic element; and an interrupter blade reset button; said interrupter blade reset button having an activated position and an inactivated position, said circuit overload indicator light being mounted onto or within said button housing by suitable attachment means, each said lead line being retained within a recess formed within said button housing, said first lead line being interconnected to said first terminal by appropriate attachment means, said housing of said electrical circuit protector having an electroplated section which is in communication and attached to said second terminal by appropriate attachment means, and said second lead line being interconnected and fixedly attached by appropriate attachment means onto said electroplated section, whereby when said electrical circuit protector is subjected to an electrical overload, said interrupter blade reset button assumes said activated position which in turn automatically illuminates said circuit overload indicator light.

5. A circuit overload indicator light for use in combination with an electrical circuit protector comprising: a circuit overload indicator light; and an electrical circuit protector; said circuit overload indicator light having a first lead line and a second lead line extending there from for energizing said circuit overload indicator light, said electrical circuit protector having a housing for containment of all electrical components associated with said electrical circuit protector, said electrical circuit protector having a button housing, said all electrical components being interconnected for electrical communication there between, said electrical components including; a first terminal; a second terminal; a current responsive bimetallic element; and an interrupter blade reset button; said interrupter blade reset button having an activated position and an inactivated position, said circuit overload indicator light being mounted onto said button housing by suitable attachment means, said circuit protector housing and said button housing having a hole there through for slidably receiving each said lead line there through, said first lead line being of a sufficient length to extend from within said hole and throughout said circuit protector housing, said first lead line being fixedly attached to said first terminal by functional attachment means, said second lead line being of a sufficient length to extend from within said hole and throughout said circuit protector housing, and said second lead line being fixedly attached to said second terminal by functional attachment means, whereby when said electrical circuit protector is subjected to an electrical overload, said interrupter blade reset button assumes said activated position which in turn automatically illuminates said circuit overload indicator light.

6. The circuit overload indicator light for use in combination with an electrical circuit protector of claim 5 wherein first said functional attachment means includes said first lead line being wrapped around said first terminal, and said second functional attachment means includes said second lead line being wrapped around said second terminal.

7. A circuit overload indicator light for use in combination with an electrical circuit protector comprising: a circuit overload indicator light; and an electrical circuit protector; said circuit overload indicator light having a first lead line and a second lead line extending there from for energizing said circuit overload indicator light, said overload indicator light with said first lead line and said second lead line being contained within an elongated housing, said overload indicator light with each said lead line and said elongated housing in combination form a light stick, said electrical circuit protector having a housing for containment of all electrical components associated with said electrical circuit protector, said electrical circuit protector having a button housing, said all electrical components being interconnected for electrical communication there between, said electrical components including; a first terminal; a second terminal; a current responsive bimetallic element; and an interrupter blade reset button; said interrupter blade reset button having an activated position and an inactivated position, said circuit protector housing and said button housing having a hole there through for slidably receiving said light stick there through, said first lead line being of a sufficient length to extend from within said hole and throughout said circuit protector housing, said first lead line being fixedly attached to said first terminal by functional attachment means, said second lead line being of a sufficient length to extend from within said hole and throughout said circuit protector housing, and said second lead line being fixedly attached to said second terminal by functional attachment means, whereby when said electrical circuit protector is subjected to an electrical overload, said interrupter blade reset button assumes said activated position which in turn automatically illuminates said circuit overload indicator light.

* * * * *